US008684500B2

(12) United States Patent
Nystrom

(10) Patent No.: US 8,684,500 B2
(45) Date of Patent: Apr. 1, 2014

(54) DIAPHRAGM FOR AN ELECTROSTATIC ACTUATOR IN AN INK JET PRINTER

(75) Inventor: Peter J. Nystrom, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/567,514

(22) Filed: Aug. 6, 2012

(65) Prior Publication Data

US 2014/0036005 A1 Feb. 6, 2014

(51) Int. Cl.
*B41J 2/06* (2006.01)

(52) U.S. Cl.
USPC ..... 347/55; 347/54

(58) Field of Classification Search
USPC ..... 347/55, 54; 310/309; 200/181
See application file for complete search history.

(56) References Cited

U.S. PATENT DOCUMENTS 4,374,707 A 2/1983 Pollack
5,534,900 A * 7/1996 Ohno et al. ..... 347/54
5,685,491 A 11/1997 Marks et al.
6,100,477 A * 8/2000 Randall et al. ..... 200/181
6,608,268 B1 * 8/2003 Goldsmith ..... 200/181
7,920,319 B2 * 4/2011 Endisch et al. ..... 359/291
2006/0109309 A1 * 5/2006 Cabal et al. ..... 347/54
2010/0053271 A1 * 3/2010 Van Lierop et al. ..... 347/47
2011/0169894 A1 * 7/2011 Jilani et al. ..... 347/54

* cited by examiner

*Primary Examiner* — Henok Legesse

(74) *Attorney, Agent, or Firm* — MH2 Technology Law Group LLP

(57) ABSTRACT

Diaphragms for electrostatic actuators for inkjet printers and methods for manufacturing are provided. The method includes electroplating a first layer on a mandrel, and applying a photoresist to the first layer. The method also includes electroplating a second layer on the first layer adjacent the photoresist, such that the first and second layers form a substantially homogenous structure, and separating the photoresist from the first and second layers to expose one or more flexure recesses where the photoresist was positioned, with the diaphragm having a reduced stiffness proximal the flexure recess.

8 Claims, 6 Drawing Sheets

DIAPHRAGM FOR AN ELECTROSTATIC ACTUATOR IN AN INK JET PRINTER

FIELD OF THE DISCLOSURE

The present disclosure relates generally to electrostatic actuators for inkjet printers.

BACKGROUND

Ink ejectors or "jet stacks" are typically found in inkjet printers and enable controlled deposition of ink on a medium (e.g., paper) upon which printing is desired. Jet stacks are typically provided by a series of brazed steel plates, which include one or more manifolds to route ink received from ink reservoirs to an array of nozzles from which ink is dispensed. Jet stacks may also include actuators, for example, piezoelectric transducers connected to a power circuit, such that the actuators are selectively excitable. When excited, the actuators deflect, motivating a volume of ink to proceed through the nozzles and onto the medium. In this way, the deposition of the ink may be electrically controlled via the selective excitation of the actuators.

As higher resolution printing is desired, the density of actuators in the jet stacks increases, generally requiring smaller actuators. With piezoelectric transducers, however, reducing the size and increasing the number of transducers can lead to a variety of design and power challenges. For example, thinner, smaller piezoelectric transducers can be fragile and expensive to manufacture. Further, cost-effective electrical interconnects for such arrays of piezoelectric transducers can limit the practical density of the actuators.

Electrostatic actuators have been proposed to avoid such challenges. With electrostatic actuators, micro-electromechanical system (MEMS) technology can be employed, e.g., using microelectronics techniques such as deposition, lithography, etching, etc., to achieve gains in the scalability of the actuator arrays. Further, such electrostatic actuators can include a thin diaphragm bonded to a substrate, with the thin diaphragm flexing by application of electrostatic force, thereby providing the selectable motivation of the ink through the nozzles.

Implementation of such electrostatic actuators, however, presents other, unique challenges. For example, to fabricate the thin diaphragms, metal (or another material) is often rolled and/or etched to arrive at a desired thickness. However, in combined etching and rolling processes, rolling the thin layer can introduce grain defects in the material, which can reveal themselves during the etching process as pin holes. Furthermore, such etching processes are often capital intensive and require large volumes to justify the cost. Also, such etching processes may result in loose tolerances.

On the other hand, when the diaphragm is formed simply by rolling, the surface of the diaphragm generally conforms to the roller surface, and thus any defects in the surface of the rollers are exhibited in the material layer. Thus, the diaphragm, when produced by rolling operations, often requires secondary polishing processes to arrive at a desired smoothness. Further, the defects in the grain boundaries may be present in such non-etching fabrication processes as well. Moreover, with either technique, the resultant thin (e.g., 15-20 μm) diaphragm can be fragile, which may reduce yield productivity.

What is needed then is an improved electrostatic actuator and method for manufacturing such an actuator.

SUMMARY

Embodiments of the disclosure may provide a method of forming a diaphragm for an electrostatic actuator in a printer jet stack. The method includes electroplating a first layer on a mandrel, and applying a photoresist to the first layer. The method also includes electroplating a second layer on the first layer adjacent the photoresist, such that the first and second layers form a substantially homogenous structure, and separating the photoresist from the first and second layers to expose one or more flexure recesses where the photoresist was positioned, with the diaphragm having a reduced stiffness proximal the flexure recess.

Embodiments of the disclosure may also provide a method for manufacturing an actuator for a jet stack of a printer. The method includes forming a diaphragm including a flexure recess by electroplating one or more layers of material on a mandrel, and separating the diaphragm from the mandrel. The method also includes disposing the diaphragm substantially parallel to an electrode layer, such that a gap is formed between the diaphragm and the electrode layer. The diaphragm is configured to move relative to the electrode layer when an electrical current is applied to at least a portion of the electrode layer.

Embodiments of the disclosure may further provide an actuator apparatus for a jet stack of a printer. The apparatus includes an electrode layer including a conductive trace and an electrode, with the electrode electrically coupled with the conductive trace. The apparatus also includes a diaphragm offset from the electrode layer by a gap. The diaphragm includes a piston section disposed substantially parallel to the electrode layer and aligned with the electrode, and a flexure recess at least partially surrounding the piston section. The diaphragm is configured to bend proximal the flexure recesses when a current is applied to the electrode, such that the piston section moves relative to the electrode layer and remains substantially parallel thereto.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings.

Figure 1:
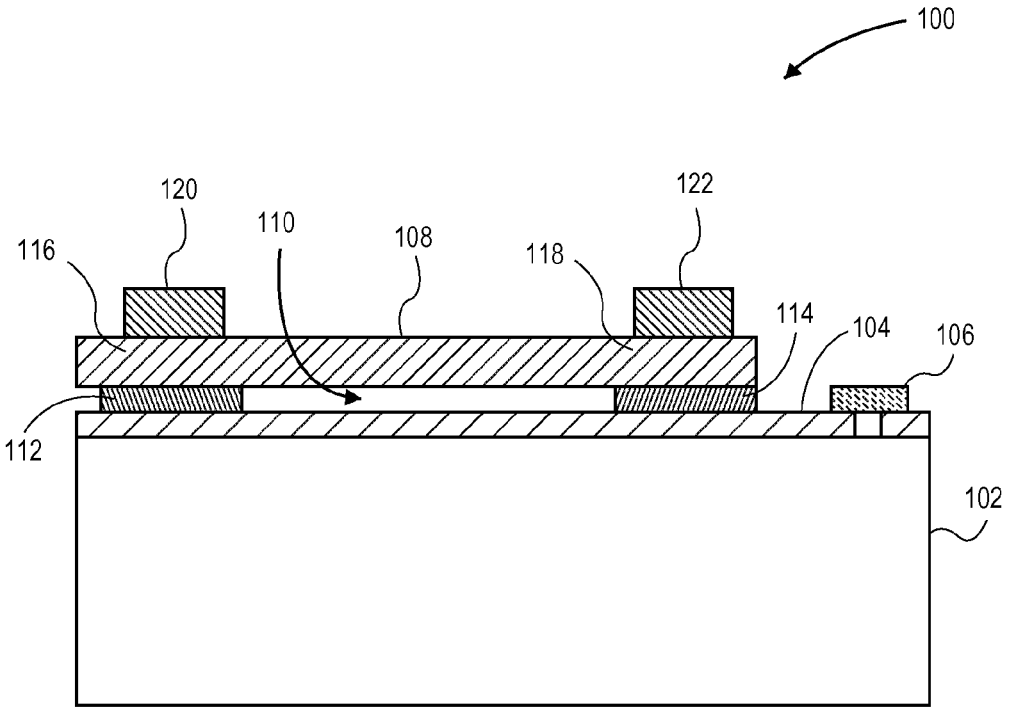
FIG. 1 illustrates a schematic side view of an electrostatic actuator for a printer head, according to an embodiment.

It should be noted that some details of the figure have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawing. In the drawings, like reference numerals have been used throughout to designate identical elements. In the following description, reference is made to the accompanying drawing that forms a part thereof, and in which is shown by way of illustration a specific exemplary embodiment in which the present teachings may be practiced. The following description is, therefore, merely exemplary.

Referring to the figures in general, embodiments of the present disclosure provide a diaphragm and method of making a diaphragm for an electrostatic actuator. The diaphragm generally includes one or more full-thickness sections, which may include stationary "node" sections and movable "piston" sections, and one or more reduced-thickness, flexure recesses. The node sections may be bonded to a substrate, the piston sections may be aligned with electrodes of an electrode layer bonded to the substrate, and the flexure recesses may be aligned with one or more traces provided by the electrode layer. The traces may be coupled with electrodes, which are configured to apply an electrostatic force on the diaphragm.

The combination of such full and reduced thickness sections in the diaphragm may reduce the amount of current used to provide the desired volumetric displacement with the actuator, while maintaining strength and robustness of the diaphragm. More particularly, the flexure recesses may provide regions of reduced stiffness in the diaphragm, serving to isolate the "bending" movement in the diaphragm that occurs by application of current to the electrodes via the traces. With the bending movement isolated in the regions of the diaphragm generally aligned with or adjacent to the flexure recesses, the piston sections may remain generally parallel to the electrode layer, while being moved along a generally linear path by the bending of the diaphragm at the flexure recesses. In addition to optimizing strength and power requirements, in some embodiments, this configuration, with the piston section remaining generally planar, may also provide a more uniform pressure head on an associated volume of ink.

Embodiments of the disclosure further provide a method for manufacturing such a variable thickness diaphragm for an actuator. The method may include electroplating one or more layers of any suitable material, e.g., nickel (or others, as described below), using one or more photoresists to control the precise material deposition. A mandrel may be used as the base for the electroplating, which may be plated glass, or may be a metal that is polished, such that the mandrel has a suitably small level of non-planar "defects" which may be transferred to the bottom of the diaphragm. Such electroplating may provide for tightened tolerances of the diaphragm, while avoiding drawbacks often associated with rolling and etching processes.

Turning now to the illustrated embodiments, FIG. 1 depicts a schematic side view of an electrostatic actuator (hereinafter, "actuator") 100, according to an embodiment, which may form part of a jet stack for an inkjet printer. The actuator 100 may be mounted to a substrate 102, which may be a glass substrate, although other materials may be employed. Further, the actuator 100 may be one of an array of actuators mounted to the glass substrate 102. It will be appreciated that the other actuators in the array may be the same or different from the actuator 100 described herein.

The actuator 100 may include an electrode layer 104 coupled with the glass substrate 102. For example, the electrode layer 104 may be or include a thin film metallization, as is known in the art, whereby a metallic layer is plated onto the glass substrate 102. Further, the electrode layer 104 may include one or more electrodes, conductive traces, etc. therein, as will be described in greater detail below. The actuator 100 may also include an integrated circuit 106, which may be an application-specific integrated circuit (ASIC) and may be coupled to the electrode layer 104. It will be appreciated that a single integrated circuit 106 may include a plurality of input and output ports (e.g., 256 or more) so as to control multiple actuators 100.

The actuator 100 may also include a diaphragm 108, which may be a thin layer of electrically-conductive material. The diaphragm 108 may be formed from an electrically-conductive metal such as nickel, stainless steel, titanium, aluminum, copper, silver, combinations thereof, or the like, and/or alloys thereof. Additional details of the construction of the diaphragm 108 will be described below.

The diaphragm 108 may be positioned so as to extend substantially parallel with the electrode layer 104, but offset therefrom by a gap 110 therebetween. The gap 110 may have a substantially uniform thickness, at least until the diaphragm 108 is flexed, and may be, for example, between about 0.1 μm and about 10 μm, between about 0.5 μm and about 5 μm, between about 0.75 μm and about 2 μm. In at least one specific embodiment, the gap 110 may extend about 1 μm between the diaphragm 108 and the electrode layer 104.

The gap 110 may be maintained by one or more gap standoff layers 112, 114, which, in some embodiments, may also serve to bond the diaphragm 108 to the electrode layer 104. In other embodiments, the diaphragm 108 may be bonded or otherwise fastened to the gap standoff layers 112, 114. Moreover, the gap standoff layers 112, 114 may be dielectric. In other embodiments, other non-conductive devices, processes, and/or structures may be employed to couple the diaphragm 108 to the electrode layer 104 and/or provide the gap 110.

Further, the gap standoff layers 112, 114 may be positioned proximal node sections 116, 118 of the diaphragm 108. The node sections 116, 118 may define regions where the diaphragm 108 is generally constrained from motion relative the glass substrate 102, e.g., by being secured thereto via the gap standoff layers 112, 114. The diaphragm 108 may flex between the node sections 116, 118, as will be described in greater detail below. In various embodiments, the gap standoff layers 112, 114 may thus serve one or more of the following functions: preventing electrical conduction from the electrode layer 104 to the node sections 116, 118; securing the diaphragm 108 to the electrode layer 104 and/or the glass substrate 102; and bridging the gap 110 between the diaphragm 108 and the substrate 102, so as to transmit any forces incident on the diaphragm 108 to the substrate 102.

The actuator 100 may also include one or more body spacers 120, 122, which may provide a standoff between the actuator 100 and adjacent structures, e.g., plates, manifolds, etc. of the jet stack. The body spacers 120, 122 may be aligned with the node sections 116, 118, so as to promote transmission of any impulse forces incident thereon to the substrate 102, thereby protecting the suspended region of the diaphragm 108 between the node sections 116, 118.

In exemplary operation, the actuator 100 may be disposed in an ink channel of a jet stack; accordingly, actuation of the actuator 100 may be employed to force ink either through holes cut, etched, or otherwise formed through the glass substrate 102, or away from the glass substrate 102, e.g., to a nozzle plate disposed adjacent. Such controlled ejection of ink may be employed to control deposition of the ink on a printable medium. It will be appreciated that directional terms such as "above" are relative in nature and refer to one orientation among many contemplated.

In the illustrated embodiment, the integrated circuit 106 may cause a current of a specified polarity to be applied across at least a portion of the electrode layer 104. The current may generate an electrostatic force, which may be applied to the diaphragm 108, attracting the diaphragm 108 to the electrode layer 104. The electrode layer 104 may be stably secured to the glass substrate 102, while the diaphragm 108 is secured at its node sections 116, 118 to the electrode layer 104 and/or the glass substrate 102 via the gap standoff layers 112, 114. Accordingly, the electrostatic force may cause a section of the diaphragm 108 between the node sections 116, 118 to flex toward the electrode layer 104, thereby storing potential energy with the deflection of the diaphragm 108.

When the current is removed and/or the polarity thereof reversed, the electrostatic force may be removed or reversed in direction. The diaphragm 108 may resiliently proceed back to a position parallel to the electrode layer 104, and/or beyond parallel, away from the electrode layer 104. Additional molten or otherwise fluidic ink may be communicated to the actuator 100, so as to replace the ink displaced through the various nozzles by the movement of the diaphragm 108. Accordingly, the actuator 100 may be primed for the next actuation.

Figure 2:
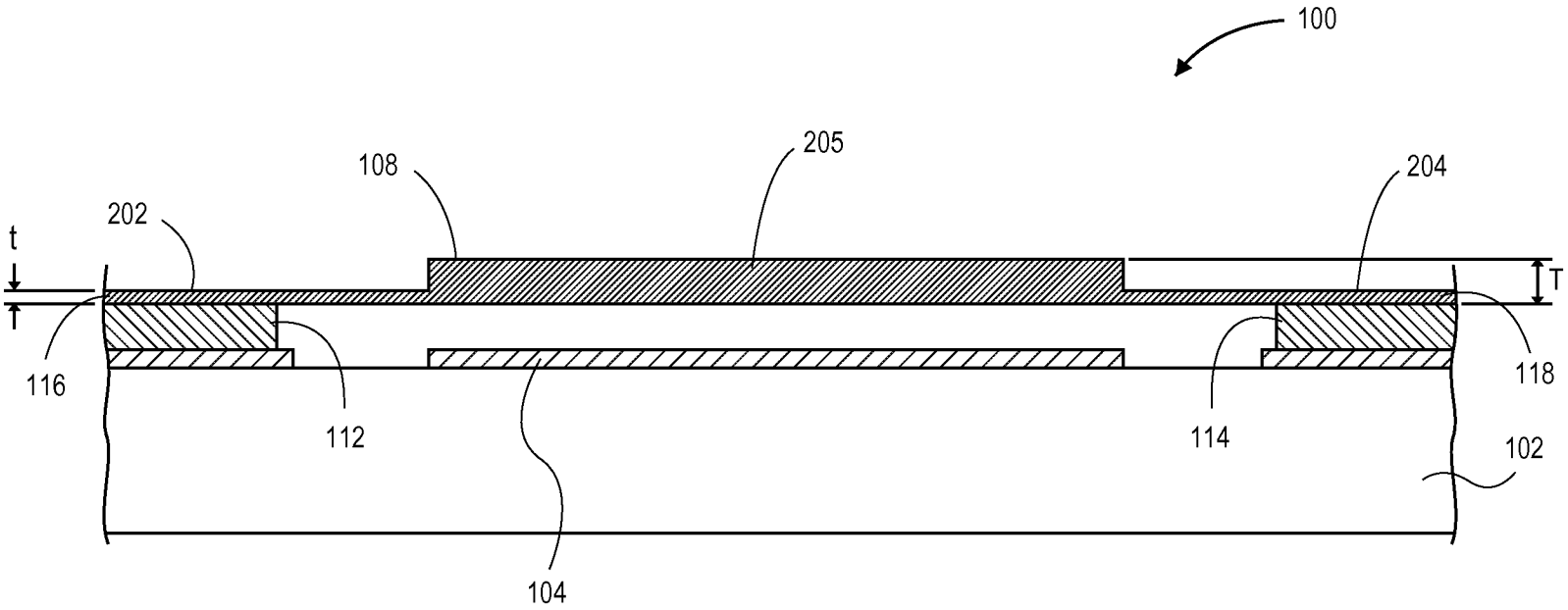
FIG. 2 illustrates an enlarged, schematic view of the electrostatic actuator, according to an embodiment.

FIG. 2 illustrates an enlarged schematic side view of the actuator 100, according to an embodiment. In the illustrated embodiment, the diaphragm 108 includes two thinner flexure recesses 202, 204 proximal the node sections 116, 118, and a thicker piston section 205 extending therebetween. The diaphragm 108 may thus have at least two thicknesses: a "reduced" thickness t at the flexure recesses 202, 204 and a "full" thickness T of the piston section 205. Accordingly, in various embodiments, the flexure recesses 202, 204 may also be described as shoulders, grooves, and/or the like.

In an embodiment, the diaphragm 108 including both the reduced-thickness flexure recesses 202, 204 and the full-thickness piston section 205 may provide a desired tradeoff between current required to flex the diaphragm 108, and diaphragm 108 strength. That is, the reduced thickness t at the flexure recesses 202, 204 may facilitate the flexing of the diaphragm 108, while the piston section 205 provides strength to the diaphragm 108, such that the diaphragm 108 may be less easily damaged. Moreover, the flexure recesses 202, 204 may, in some embodiments, extend over the gap standoff layers 112, 114, as shown; however, in other embodiments, as shown in FIG. 3 and described below, a full-thickness region of the diaphragm 108 may provide the node sections 116, 118, which extend over the gap standoff layers 112, 114, while the flexure recesses 202, 204 extend away from the node sections 116, 118.

In some embodiments, the flexure recesses 202, 204 may be formed by etching the diaphragm 108, while a mask (e.g., photoresist) is applied to keep the piston section 205 from being reduced in thickness. Since the piston section 205 may not be reduced in thickness, it may therefore be referred to as having a "full" thickness; however, it will be appreciated that the piston section 205 may be etched, while still providing a relatively thicker portion of the diaphragm 108, and thus may be referred to as having a "full" thickness. Moreover, the resultant flexure recesses 202, 204 may not have an entirely uniform reduced thickness t. In at least one embodiment, the reduced thickness t may be between about 20% and about 70% of the full thickness T, for example, on average, between about 40% and about 50% of the full thickness T. In at least one embodiment, the reduced thickness may vary by up to 10% of the full thickness T in the diaphragm 108.

In various embodiments, the diaphragm 108 may have a full thickness T of between about 1 μm and about 100 μm, between about 10 μm and about 50 μm, or between about 12 μm and about 25 μm. In one specific embodiment, the full thickness T may be about 12 μm, and in another, may be about 20 μm. In other embodiments, the diaphragm 108 may have a full thickness T of about 38 μm, which may be typical for etched stainless steel.

Figure 3:
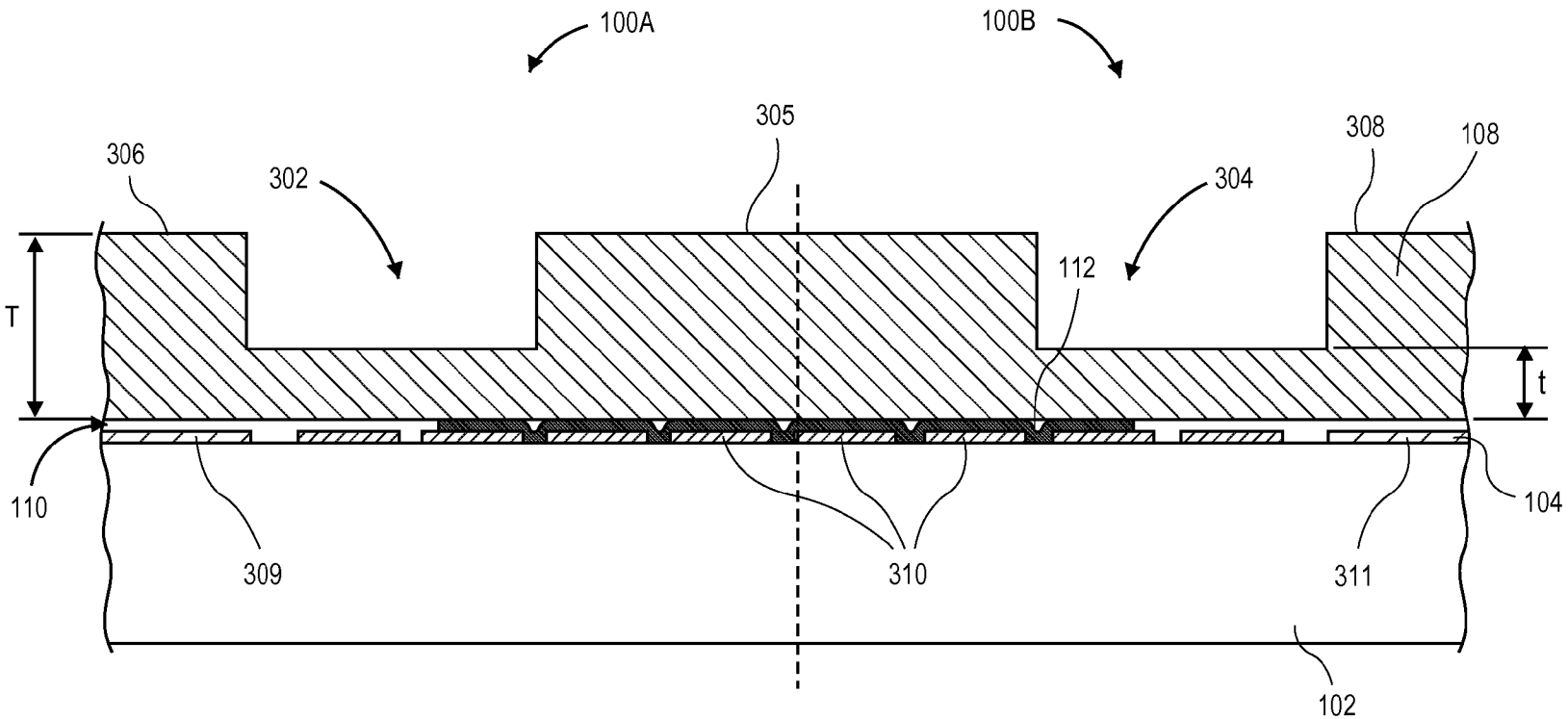
FIG. 3 illustrates a schematic view of a node, a flexure recess, and two piston regions, which form portions of two adjacent actuators, according to an embodiment.

FIG. 3 illustrates a schematic side view of portions of two adjacent actuators 100A, 100B, according to an embodiment. As shown, the diaphragm 108 includes flexure recesses 302, 304, a node section 305 extending therebetween, and first and second piston sections 306, 308. Each of the flexure recesses 302, 304 and each of the piston sections 306, 308 may be provided by different actuators 100A, 100B, respectively, and the node section 305 may be shared between the two actuators 100A, 100B, such that both actuators 100A, 100B may be characterized as including the node section 305. The separation of the actuators 100A, 100B is illustrated by a dashed line through the middle of the node section 305; however, it will be appreciated that this separation may be conceptual, rather than physical, in at least some embodiments.

The diaphragm 108 at the flexure recesses 302, 304 may have a reduced thickness t, as compared to the full thickness T at the piston sections 306, 308. Further, the node section 305 may also have the full thickness T and may be generally constrained from movement relative the glass substrate 102 by the gap standoff layer 112. As noted above, the gap standoff layer 112 may also adhere the node section 305 to the glass substrate 102, but in other embodiments, may generally lack sufficient adhesive properties, such that the node section 305 is secured to the gap standoff layer 112, which is secured to the glass substrate 102, for example, by one or more additional adhesive layers, fasteners, etc.

The electrode layer 104 may include a plurality of conductive traces 310 and electrodes 309, 311, with at least some of the traces 310 being electrically coupled with the electrodes 309, 311. The electrode 309 may be aligned with the piston section 306, and the electrode 311 may be aligned with the piston section 308, such that application of electrical current to the electrodes 309, 311 via the connected traces 310 causes an electrostatic force to be applied to the piston sections 306, 308, respectively. At least some of the conductive traces 310 may be disposed in or in alignment with the gap standoff layer 112, while others may be disposed outside of and/or out of alignment with the gap standoff layer 112. Moreover, the traces 310 may be capable of independent delivery of current to the electrodes 309, 311, such that, for example, the actuators 100A, 100B are able to be actuated independently.

The flexure recesses 302, 304 may, for example, facilitate such movement of the piston sections 306, 308, by providing an area of reduced stiffness in the diaphragm 108. Thus, the bending movement of the diaphragm 108 can be substantially localized in the diaphragm 108 bordering the flexure recesses 302, 304, such that the piston sections 306, 308 may move either toward or away from the glass substrate 102, without substantially bending. Further, the node region 305 may form a generally solid structure with the glass substrate 102, via connection with the gap standoff layer 112, the electrode layer 104, and the gap standoff layer 112. With the node region 305 having the full thickness T, the actuator 100 thus may have a maximum strength at the node region 305.

Figure 4:
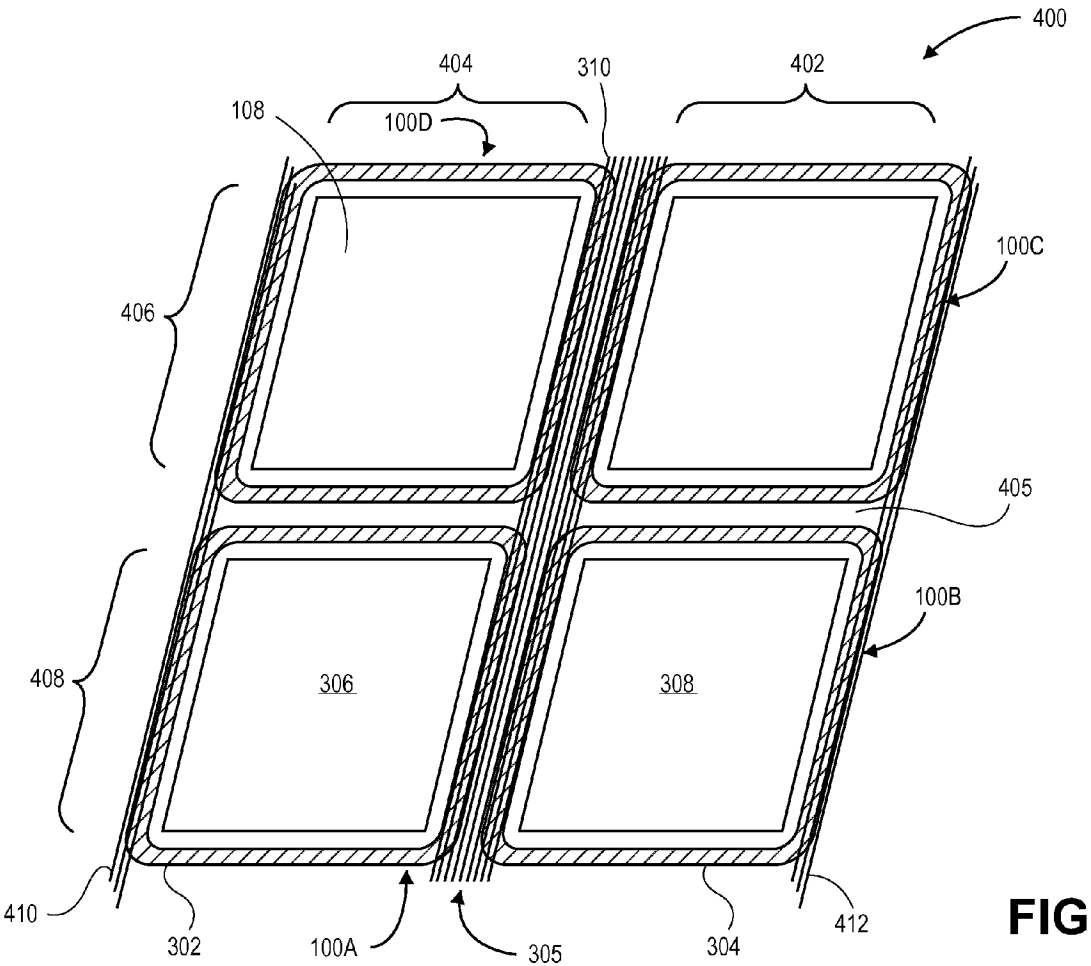
FIG. 4 illustrates a schematic front perspective view of an array of actuators, according to an embodiment.

FIG. 4 illustrates a schematic view of an actuator array 400, generally showing the diaphragm 108, which may be employed across several, or even all, of the actuators 100 of the array 400. As illustrated, the array 400 may include four of the actuators 100 (labeled 100A, 100B, 100C, 100D); however, it will be appreciated that the depiction of four actuators 100 in the array 400 is merely for illustrative purposes and, in practice, tens, hundreds, thousands, or more of such actuators 100 may be employed in an individual array 400.

The diaphragm 108 may thus include the piston section 306, for the actuator 100A, and the piston section 308, for the actuator 100B. The flexure recess 302 may envelope, circumscribe, or otherwise surround at least a portion of the piston section 308. Likewise, the flexure recess 304 may envelope, circumscribe, or otherwise surround at least a portion of the piston section 308. The node section 305 may be defined between the piston sections 306, 308 as well as, for example, between adjacent sides of the flexure recesses 302, 304.

In FIG. 4, the electrode layer 104 (FIGS. 1 and 2) may be considered "behind" the diaphragm 108. Accordingly, the traces 310 may extend generally parallel to and be aligned with the node section 305, as shown. Additional traces 410, 412 may also be provided in the electrode layer 104, extending generally parallel to the traces 310.

In an embodiment, the actuators 100A-D of the array 400 may be generally arranged in a grid pattern, such that the node section 305 extends and is common to adjacent columns 402, 404 of actuators 100. More particularly, in at least one embodiment, as shown, the actuators 100A-D may each be generally parallelogram shaped, such that the grid pattern is also generally a parallelogram, characterized by non-square angles between intersecting and/or adjacent components. However, in other embodiments, square angles may be employed in addition to or instead of such non-square angles. The traces 310 may extend along with the node section 305, so as to also be aligned actuators 100 in adjacent columns 402, 404. Further, a second node section 405 may extend at an angle to the node section 305 and may be common to actuators 100 in adjacent rows 406, 408 of the array 400.

The traces 410, 412 may be aligned at least partially with the flexure recesses 302, 304 and may thus cooperate with the traces 310 to provide current to electrodes of the electrode layer 104, thereby selectively applying electrostatic force to the diaphragm 108. In some embodiments, the traces 410, 412 may extend parallel to the traces 310, but in other embodiments, one or more of the arrays of traces 410, 412 may be disposed perpendicular to the traces 310, for example, aligned with and extending parallel to the node section 405.

In operation, an electrical current may be selectively applied through one or more of the traces 310, 410, 412, so as to provide current to electrodes aligned with the piston sections 306, 308, so as to generate an electrostatic force on one or more regions of the diaphragm 108. When applied, the force may act, for example, to bend the diaphragm 108 at or adjacent to the flexure recesses 302, 304. This may, in turn, draw the piston sections 306, 308, at least partially surrounded by the flexure recess 302, 304, respectively, toward the glass substrate 102, with a minimum (e.g., no or substantially no) bending of the piston section 306, 308. When the current is stopped, or the polarity thereof reversed, the electrostatic force on the flexure recesses 302, 304 may be removed or reversed, and thus energy stored in the displaced piston sections 306, 308 may be released. This may displace a corresponding volume of liquid ink disposed in proximity to the actuators 100A-D, for example, driving the ink through nozzles in a nozzle plate, through a manifold, or the like.

It will be appreciated that the flexure recesses 302, 304 surrounding the piston sections 306, 308, respectively, is but one embodiment among many contemplated. In some embodiments, the flexure recesses 302, 304 may not be continuous and/or may not surround the piston sections 306, 308. For example, the flexure recess 302 may be segmented into one or more rectilinear or curved sections. Such sections may extend parallel to one another (e.g., on opposite sides of the piston section 306), may intersect or meet (e.g., on adjacent sides of the piston 306), or may be aligned so as to cooperatively form at least a portion of a circle, polygon, or another shape around the piston section 306.

Further, it will also be appreciated that the grid pattern in which the array 400 is arranged is also but one embodiment among many. In other embodiments, the actuators 100 of the array 400 may be in an offset configuration, by row and/or column, such either node regions 305 or node regions 405 do not form a straight line.

Figure 5A:
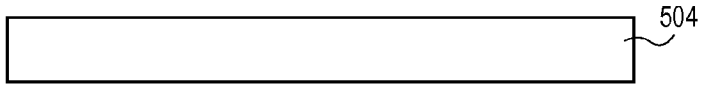
FIGS. 5A-5F illustrate schematic side views of the diaphragm as it is being formed, according to an embodiment.
Figure 5B:
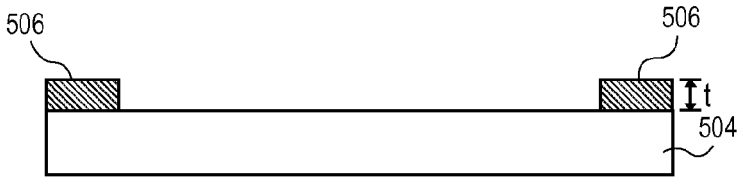
Figure 5C:
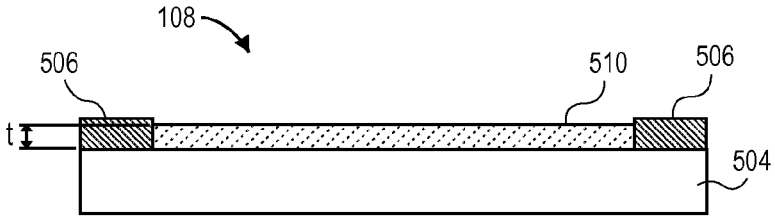
Figure 5D:
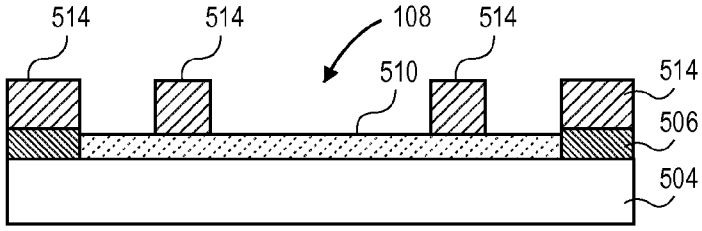
Figure 5E:
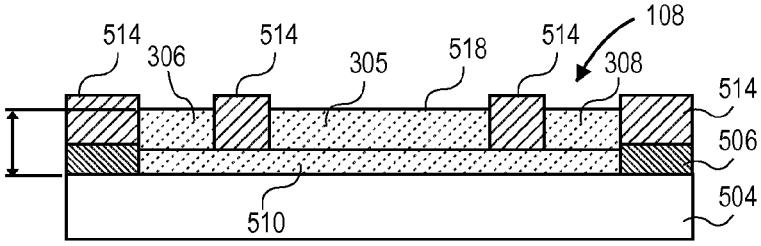
Figure 5F:
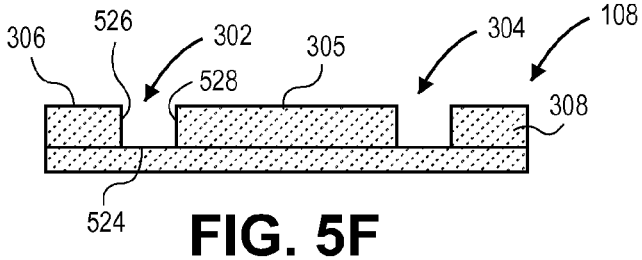
Figure 6:
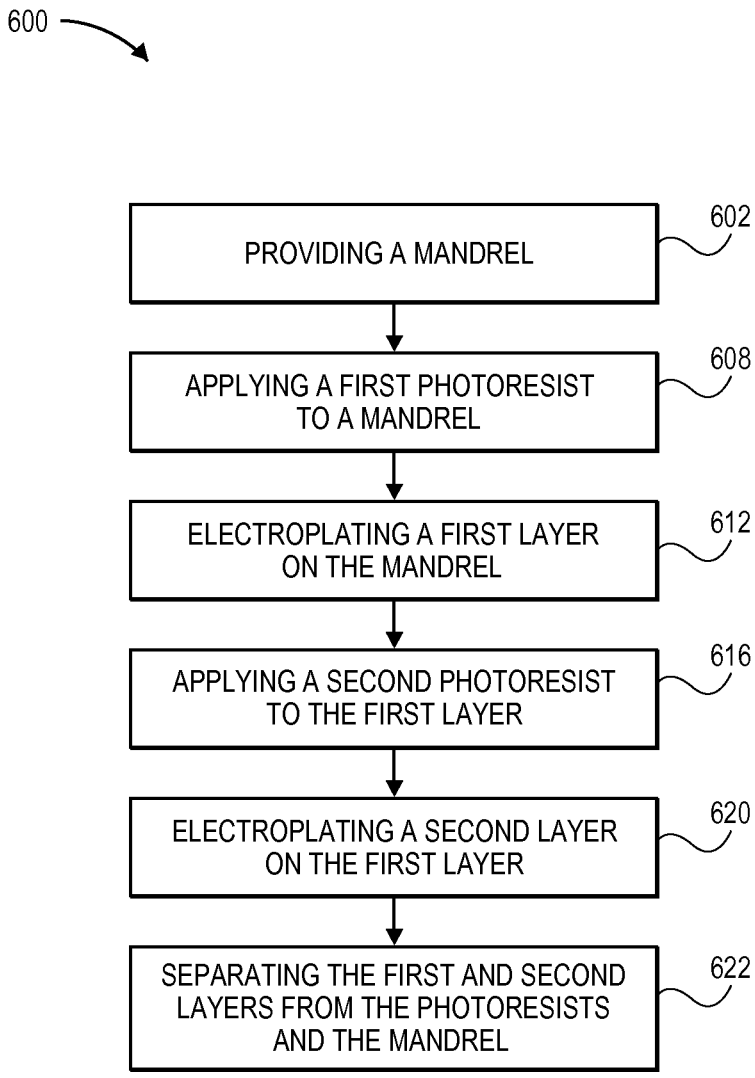
FIG. 6 illustrates a flowchart of a method for manufacturing an electrostatic actuator, according to an embodiment.

Reference is now made to FIGS. 5A-5F and 6. FIGS. 5A-5F schematically illustrate the diaphragm 108 at various stages of fabrication, according to an embodiment, and FIG. 6 illustrates a flowchart of a method 600 for fabricating the diaphragm 108, according to an embodiment. The method 600 may begin at 602, by providing a mandrel 504, as shown in FIG. 5A. The mandrel 504 may be a metallic conductor, suitable for electroplating. Furthermore, the mandrel 504 may be polished, so as to have a generally smooth surface. In some embodiments, the mandrel 504 can be a metal-plated glass structure. In various embodiments, the mandrel 504 may be fabricated and/or finished so as to minimize the frequency and size of non-planar areas or "defects" (i.e. peaks or valleys in the face), such that the defects have a height of less than about 100 nm.

The method 600 may then proceed to 608, where it includes applying a first photoresist 506 to the mandrel 504, as shown in FIG. 5B. The first photoresist 506 may be a pattern, providing two (as shown), three, four, up to hundreds or more areas that may resist electroplating. A variety of photoresist materials are known, and the first photoresist 506 may include any one or more suitable photoresist materials. Furthermore, the first photoresist 506 may have a thickness that is approximately equal to or slightly larger than the reduced thickness t, discussed above. The first photoresist 506 may be applied, for example, as a mold for where pin holes or other features may be desired extending into and/or through the diaphragm 108.

The method 600 may then proceed to 612, electroplating a first layer 510 on the mandrel 504, for example, at least adjacent the first photoresist 506, as shown in FIG. 5C. The first layer 510 may serve as a base for the diaphragm 108 and may have the reduced thickness t. With the first photoresist 506 being slightly thicker than the reduced thickness t, the first photoresist 506 may serve to contain portions of the first layer 510 within predefined regions, restrict the application of the first layer 510, etc., such that the first layer 510 does not cover the areas occupied by the first photoresist 506. Further, the first layer 510 may be formed from nickel, gold, silver, tin, cadmium, zinc, platinum, palladium, any steel alloy (e.g., a stainless steel alloy), or any other alloy or element suitable for electroplating onto the mandrel 504.

Next, at 616, the method 600 may include applying a second photoresist 514 to the first layer 510, as shown in FIG. 5D. The second photoresist 514 may be disposed where the flexure recesses 302, 304 are desired, i.e., where the diaphragm 108 is to have the reduced thickness t. The second photoresist 514 may also be applied to the first photoresist 506, so as to preserve the features that are desired to extend through the diaphragm 108; however, in some embodiments, the first photoresist 506 may be omitted, such that the second photoresist 514 is applied without the first photoresist 506.

The method 600 may then proceed to 620, there including electroplating a second layer 518 on the first layer 510, at least adjacent the second photoresist 514, as shown in FIG. 5E. The second layer 518 may be the same material as the first layer 510, such that, upon electroplating the second layer 518 to the first layer 510 a homogenous structure is produced. As the term is used herein, "homogenous structure" is generally defined to mean that the microstructure of the first and second layers 510, 518 does not exhibit a substantial boundary, i.e., do not exhibit a seam such as would be formed by brazing, welding, gluing, etc., two discrete layers together, but, rather, act as a single, continuous structure.

The second layer 518 may have a thickness that is substantially the difference between the full thickness T and the reduced thickness t. Accordingly, regions where the second layer 518 is applied to the first layer 510 may result in the full thickness T for the diaphragm 108 at that section. For example, intermediate two portions of the second photoresist 514 may be found portions of the piston section 306, the node section 305, and the piston section 308. The process of applying a photoresist and electroplating a layer may be repeated one or more times, as desired, to arrive at a desired geometry, for example, the geometry of the diaphragm 108 described above.

Once the desired geometry is achieved, the method 600 may proceed to 622, where the diaphragm 108 may be separated from the mandrel 504, the first photoresist 506, and the second photoresist 514, as shown in FIG. 5F. Various methods are known for separating an electroplated structure from a mandrel and a photoresist, such as heating and/or cooling to capitalize on disparate thermal expansion rates of the different materials. Any such separation or "stripping" method may be employed without departing from the scope of the present disclosure.

The resulting diaphragm 108 may thus be a two layer structure, which may be substantially homogenous. As such, the first layer 510 may define a bottom 524 of the flexure recesses 302, 304, while the second layer 518 defines lateral sides 526, 528 of the flexure recesses 302, 304. Thus, removing the second photoresist 514 may reveal the flexure recesses 302, 304. Further, the piston sections 306, 308 and the node section 305 may be defined by the combination of the first and second layers 510, 518 so as to provide the full thickness T; however, it will be appreciated that one or more additional layers may be added to either the first layer 510 or second layer 518 (or both) to arrive at the desired thicknesses.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An actuator apparatus for a jet stack of a printer, comprising:

an electrode layer comprising a conductive trace and an electrode, wherein the electrode is electrically coupled with the conductive trace; and a diaphragm offset from the electrode layer by a gap, the diaphragm comprising:

a planar first surface facing toward the electrode layer;

a non-planar second surface opposite the first surface and facing away from the electrode layer, wherein the non-planar second surface comprises a piston section disposed substantially parallel to the electrode layer and aligned with the electrode, wherein the piston section comprises a protrusion that extends away from the first surface of the diaphragm and away from the electrode layer; and a flexure recess at least partially surrounding the piston section, wherein the diaphragm is configured to bend proximal the flexure recesses when a current is applied to the electrode, such that the piston section moves relative to the electrode layer and remains substantially parallel thereto.

2. The actuator apparatus of claim 1, wherein the electrode layer comprises a thin film metallization applied to a glass substrate.

3. The actuator apparatus of claim 1, wherein the conductive trace of the electrode layer is at least partially aligned with the flexure recess of the diaphragm.

4. The actuator apparatus of claim 1, wherein the diaphragm comprises a first electroplated layer and a second electroplated layer, wherein the piston section is defined by a combination of a portion of the first electroplated layer and at least a portion of the second electroplated layer, and the flexure recess is defined by a horizontal upper surface of the first electroplated that provides a first portion of the non-planar second surface and by vertically oriented sides of the second electroplated layer, wherein the second electroplated layer provides a second portion of the non-planar second surface.

5. The actuator apparatus of claim 4, wherein the first electroplated layer and the second electroplated layer are formed from a same material.

6. The actuator apparatus of claim 1, further comprising a gap standoff dielectric disposed in the gap between the planar first surface of the diaphragm and the electrode layer, wherein the gap standoff dielectric physically contacts the planar first surface of the diaphragm and the conductive trace.

7. The actuator apparatus of claim 6, further comprising a node section having a thickness that is greater than a thickness of the diaphragm where the flexure recesses are defined, the node section being coupled with the gap standoff dielectric, such that the node section is generally stationary relative to the electrode layer.

8. The actuator apparatus of claim 1, wherein the planar first surface of the diaphragm electrode lay comprises non-planar defects of less than about 100 nm.

* * * * *